United States Patent [19]

Atkins

[11] 4,428,555

[45] Jan. 31, 1984

[54] EASEL-TYPE MOUNT

[75] Inventor: Douglas C. Atkins, Middleboro, Mass.

[73] Assignee: Winthrop-Atkins Co., Inc., Middleboro, Mass.

[21] Appl. No.: 360,666

[22] Filed: Mar. 22, 1982

[51] Int. Cl.[3] ..... A47B 97/04

[52] U.S. Cl. ..... 248/459; D19/20; 40/120; 248/174; 248/460

[58] Field of Search ..... 248/459, 460, 174; 40/120, 124.1; D19/20

[56] References Cited

U.S. PATENT DOCUMENTS

| | | | |
|---|---|---|---|
| 2,855,708 | 10/1958 | Nichols | 40/124.1 X |
| 2,946,545 | 7/1960 | Sampson | 248/459 |
| 2,976,631 | 3/1961 | Paschal | 40/120 |
| 2,978,824 | 4/1961 | Paschal | 40/120 |
| 3,149,816 | 9/1964 | Nichols | 40/120 |
| 3,152,415 | 10/1964 | Nichols | 40/120 |

*Primary Examiner*—J. Franklin Foss
*Assistant Examiner*—David L. Talbott
*Attorney, Agent, or Firm*—Robert T. Gammons

[57] ABSTRACT

An easel-type mount for supporting calendars and memorandum pads on a desk of the kind embodying a display portion and headboard and a leg and brace interengageable to support the structure upright with the display portion and headboard disposed at an obtuse angle relative to each other and to a method of making the same.

12 Claims, 15 Drawing Figures

EASEL-TYPE MOUNT

BACKGROUND OF INVENTION

There are many patented easel-type desk mounts, each of which is said to embody characteristics which make it more desirable from the standpoint of use and/or manufacture from any other. Winthrop-Atkins, assignee of the instant invention, manufactures numerous calendar and memorandum easel-type supports for which it has obtained many patents. Two of these U.S. Pat. Nos. 2,902,785 and 3,152,415, disclose an easel-type structure wherein a headboard is held at an obtuse angle to a support by engagement of a brace comprised of a part of the support and a leg comprised of a part of the headboard. The easel disclosed herein affords the desirable characteristics of the aforesaid patents and has the further advantage that, by a different association of the component parts making up the structure, a sturdier mount can be made and manufacturing costs can be significantly lowered.

SUMMARY OF INVENTION

As herein illustrated, the easel comprises coextensive rectangular front and back panels of two-ply construction bound along at least two parallel edges, said panels being foldable transversely further from one end than the other to form a support and a headboard along one edge thereof and leg and brace members cut out of the panels elastically interengageable to hold the support and headboard at an obtuse angle relative to each other, said leg board comprising both plies of the back panel and the back ply of the front panel such that the front ply of the front panel is imperforate and said brace comprises both plies of the back panel. The leg comprises a rigid, in-the-same-plane extension of the back panel of the headboard, the latch comprises an in-the-same-plane extension of the rear ply of the front panel of the headboard and the brace is bent downwardly from the back panel of the support and elastically engaged with the latch. Desirably, the latch is substantially coextensive in area with the leg. The easel is formed from a blank comprising rigidly-connected panels wherein the combined lengths of three of the panels corresponds to the combined lengths of the remaining two panels and wherein the three panels constitute half the length of the blank and the other two panels the other half of the length of the blank and wherein the second and third panels are of equal length and constitute half of the blank and the fourth and fifth panels are of equal length and constitute the other half of the blank and wherein there are transversely-spaced, open-end slots at the junction of the third and fourth panels; a three-sided cut in the fourth panel, the ends of which intersect the open ends of the slots; transversely-spaced open end slots at the junction of the first and second panels, a three-sided cut in the first panel, the ends of which intersect the open ends of the slots at the junction of the first and second panels; a second three-sided cut in the first panel; a transverse score cut at the junction of the second and third panels and a transverse perforated cut at the junction of the fourth and fifth panels. The blank is made by cutting a first pair of slots in the opposite longitudinal edges of a first rectangular sheet of paper parallel to the ends of the sheet and spaced from the ends to form a first pair of slots; cutting a first easel member from the first sheet along three sides, one of which is parallel to the first pair of slots and spaced longitudinally therefrom; adhering a second sheet to the first sheet except for an area coextensive with the first easel and cutting a second pair of slots through the first and second sheets at the opposite longitudinal edges, the ends of which intersect two of the three sides of the first easel member cut from the first sheet; cutting a second easel from the first and second sheets along three sides, two of which intersect the first pair of slots and one of which is parallel to the first pair of slots and spaced longitudinally therefrom; scoring and perforating the sheets, respectively, midway between the first and second pair of slots and midway between the second pair of slots and the one end of the blank and cutting a brace from the first panel; applying the adhesive transversely of the free end of the first panel and transversely of the fifth panel at its junction with the fourth panel; folding the first and second panels into engagement with the third and fourth panels and binding at least the two opposite edges of the folded panels.

The invention will now be described with reference to the accompanying drawings, wherein.

Figure 10:
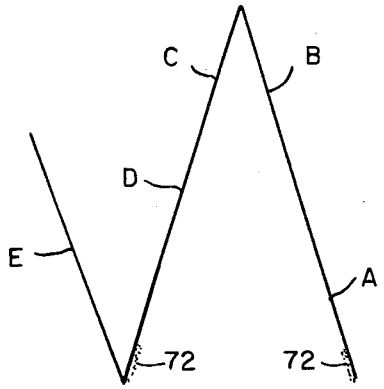
Figure 11:
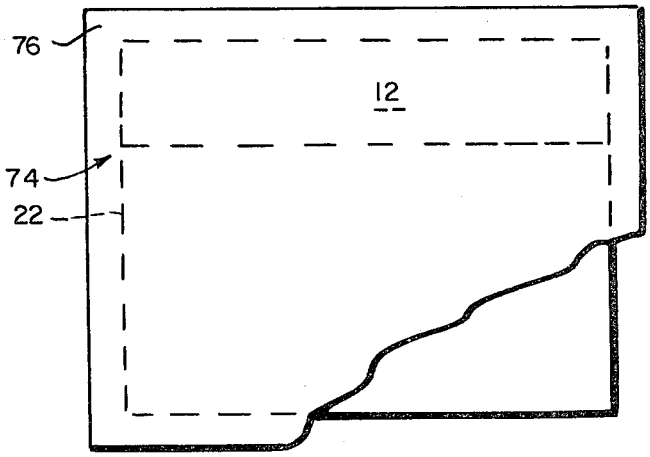
Figure 13:
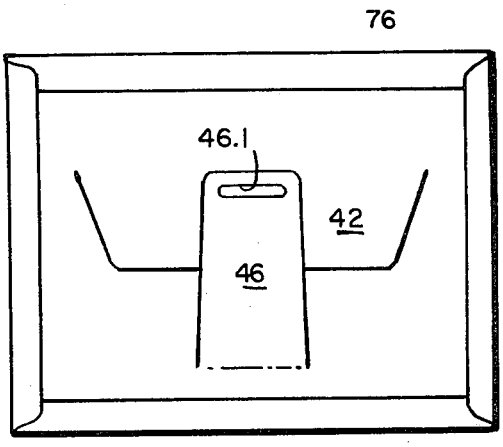
Figure 12:
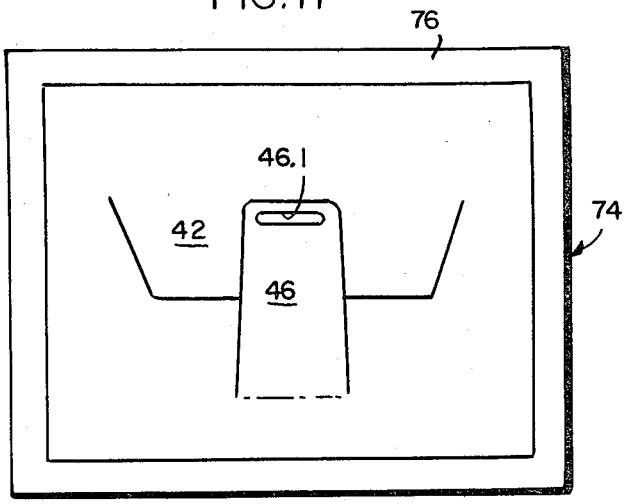
Figure 14:
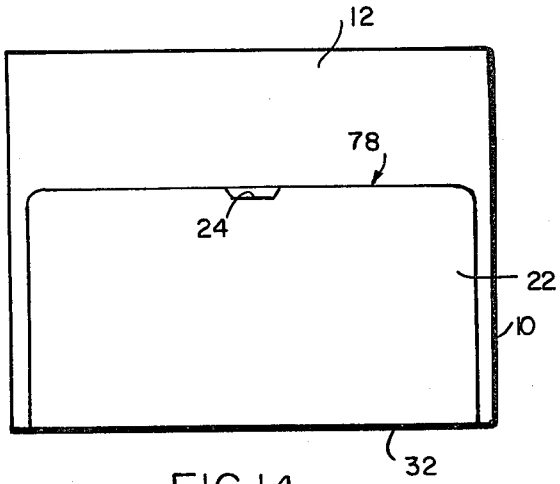
Figure 15:
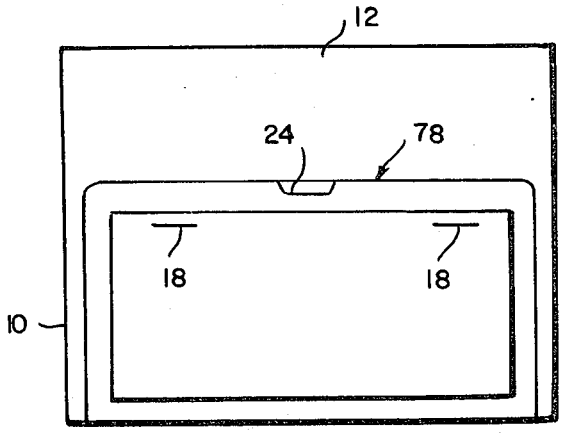

FIG. 10 diagrammatically illustrated folding the adhered and scored panels;

FIG. 11 is a plan view of the folded structure with a wrapper applied over the front side;

FIG. 12 is a rear view of the folded structure with the wrapper at the front side;

FIG. 13 is a rear view showing the wrapper folded onto the rear side;

FIG. 14 is a front view of the wrapped easel provided with a cover panel; and FIG. 15 is a view similar to FIG. 14 with a calendar pad stapled to the cover panel.

Figure 1:
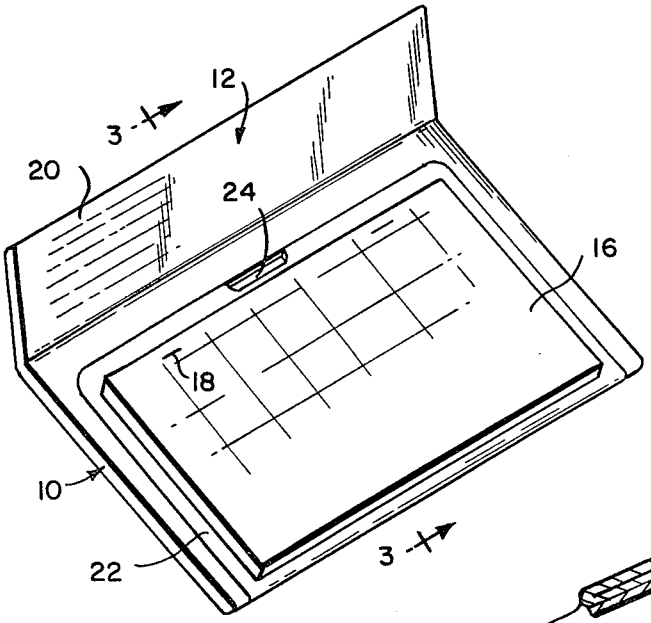
FIG. 1 is a perspective view of the easel-type calendar mount of this invention as seen from the front side.
Figure 3:
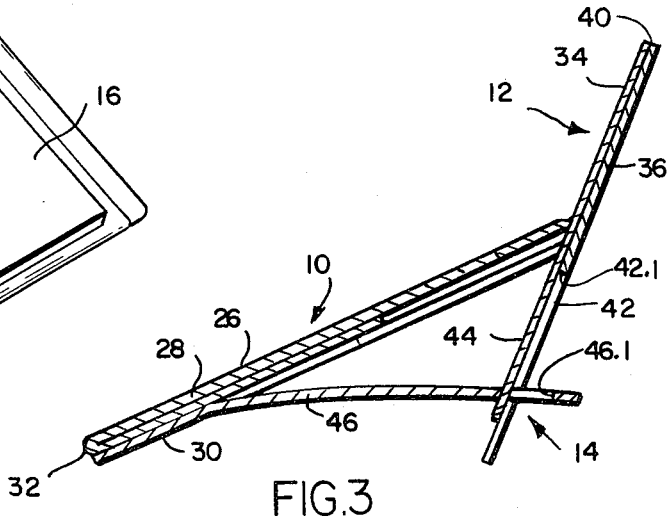
FIG. 3 is a vertical section taken on the line 3—3 of FIG. 1.
Figure 2:
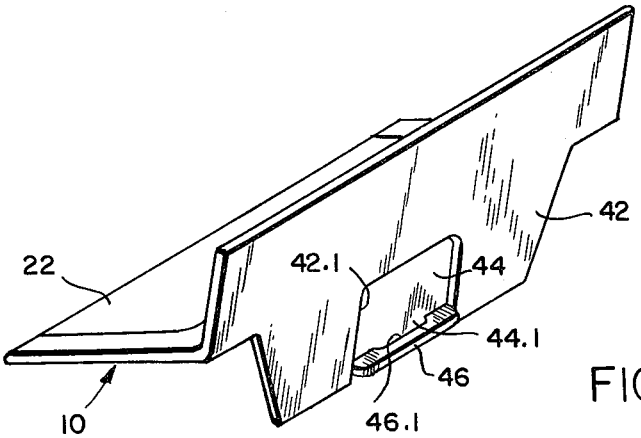
FIG. 2 is a perspective view as seen from the back side.
Figure 6:
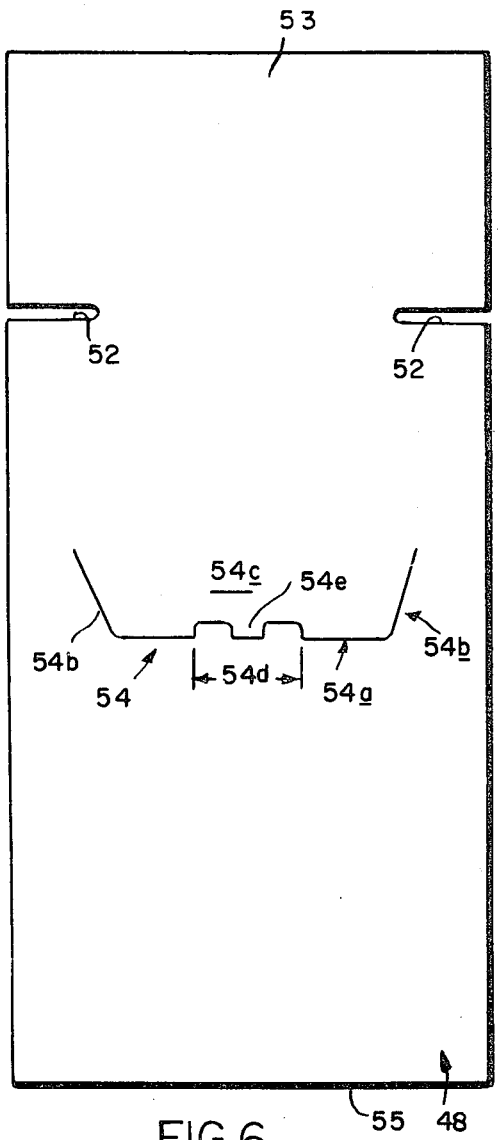
FIG. 6 is a plan view of a first panel comprising one component of the mount.

Referring to the drawings, FIGS. 1, 2 and 3, the easel-type desk calendar mount as herein illustrated comprises an inclined support 10, a headboard 12 and supporting structure 14 for supporting the easel in an upright position. The support 10 and headboard 12 are desirably positioned at an obtuse angle with respect to each other and, in one form of the invention, a calendar pad 16 is stapled to the upwardly-facing side of the support 10 by staples 18 and advertising matter 20 is embossed or printed upon the upwardly-facing side of the headboard 12. As such, the device is particularly attractive to merchants who want to advertise their products or services. Optionally, the support 10 may include a hinged panel 22 which may be folded outwardly from the face of the support 10 and, for this purpose, a finger notch 24 is formed in the upper edge of the panel 22. When folded outwardly, the inner surface of the panel 22 and the substrate surface will provide, in conjunction, surfaces upon which may be printed phone and indexes.

As shown in FIG. 3, the support 10 comprises front, intermediate and back plies 26, 28 and 30. The front ply 26 is connected at its lower end by hinge 32 to the lower end of the intermediate ply 28. The headboard 12 is comprised of front and rear plies 34 and 36. The upper end of the intermediate ply 28 is connected by a hinge to the front ply 34 of the headboard and the front ply 34 is connected at its upper edge by a hinge 40 to the upper edge of the rear ply 36. The back ply 30 of the support is connected at its lower edge to the lower edge of the intermediate ply 28 and is connected at its upper edge by a hinge 35 to the back ply 36 of the headboard.

The support structure 14 comprises a leg 42, a latch 44 and a brace 46. The leg 42 is a rigid, in-the-same-plane extension of the rear ply 36 of the headboard. The latch 44 is a rigid, in-the-same-plane extension of the front ply 34 of the headboard and the brace 46 comprises a cutout portion of the back ply 30 of the support bent downwardly from the support 10 into engagement with the latch 44. The leg 42 contains an opening 42.1 through which the distal end of the brace 46 passes and the latch 44 has a tongue 44.1 which extends through an opening 46.1 at the distal end of the brace. Optionally, the latch 44 has an opening 44.2 at its distal end for receiving a tongue 42.4 at the distal end of the leg, FIG. 9A.

Referring to FIGS. 6 to 12, the easel is made up of two rectangular coextensive sheets of paperboard 48 and 50. As a first operation in the manufacture of the easel, the rectangular sheet 48 is die-cut to provide at its opposite longitudinal edges transversely-positioned aligned slits or slots 52—52 parallel to the ends 53,55 of the sheet. These slots 52—52 are made at a distance from the end 53 which is about ¼ of the distance between the ends 53 and 55. At approximately midlength of the sheet 48, a three-sided cut 54 is made comprising a cut **54*a* parallel to the ends 53,55 and two cuts 54*b*—54*b* which extend from the opposite ends of the cut 54*a* toward the end 53 and which diverge toward the opposite sides of the sheet. The three-sided cut 54 relieves from the sheet a part 54*c* which, ultimately, will become the latch 44. A portion of the cut 54*a* contains a deviation 54*d* which defines a locking tab 54*e***.

Figure 8:
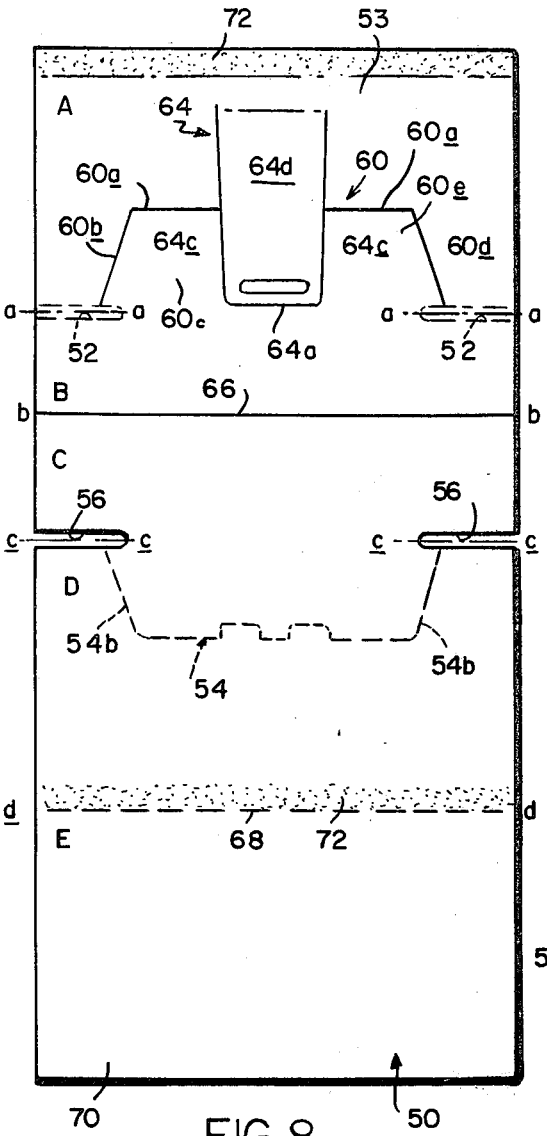
FIG. 8 is a plan view of the adhered panels following perforating and scoring.
Figure 9:
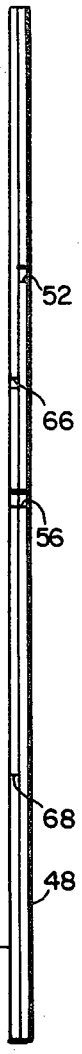
FIG. 9 is a side view of the adhered panels following perforating and scoring.
Figure 9A:
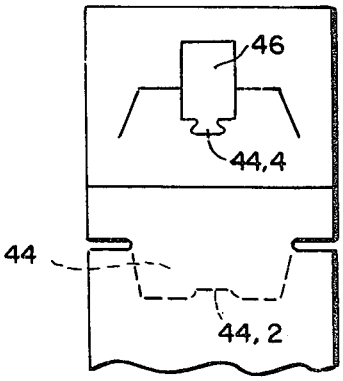
FIG. 9A is a plan view similar to FIG. 8 with a modified latch and brace.
Figure 7:
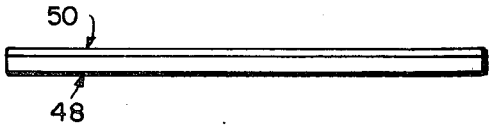
FIG. 7 is an end view of the first panel with a second panel attached thereto which is coextensive in area with the first panel.

The sheet 50 is now adhered to the sheet 48, FIG. 7, except for that portion of the area corresponding to the area of the part **54*c* destined to become the latch 44, whereupon the composite structure, FIGS. 8 and 9, is die-cut through both sheets to provide transversely-spaced slots 56—56 parallel to the slots 52—52 midway between the ends of the structure which intercept the legs 54*b*—54*b* of the three-sided cut 54. In addition, a three-sided cut 60 is made through both sheets corresponding substantially in configuration to the three-sided cut 54 comprising cuts 60*a*—60*a* parallel to the ends of the structure and diverging cuts 60*b*—60*b* which intercept the slots 52—52, thereby releasing a part 60*c* which is destined to become the leg 42. Simultaneously, a second three-sided cut 64 is made through the sheets which comprise a cut 64*a* parallel to the ends of the sheet and two nearly parallel cuts 64*c*—64*c* which release a part 64*d* which is destined to become the brace 46. Finally, a score cut 66 is made transversely of the composite structure parallel to the ends midway between the pairs of slots 52—52 and 56—56 and a perforated cut 68 is made transversely of the composite structure parallel to and midway between the pairs of slots 56—56 and the end of the composite structure. These latter cuts are confined to the sheet 50**.

As a consequence, the composite structure is comprised of five panels A, B, C, D and E foldable transversely relative to each other about transverse hinge lines *a—a, b—b, c—c* and *d—d*.

Adhesive 72 is now applied to the end 53 of the composite structure and along the perforate cut 68, FIG. 8, whereupon the structure is folded as shown diagrammatically in FIG. 10 on the lines *b—b* and *d—d* to bring the adhesive-coated surfaces 72—72 into adhesive engagement. The folded structure is bound by adhering a sheet of covering paper 74 to the front side of the structure, FIG. 11, and folding its edges 76 onto the back side as shown in FIGS. 11, 12 and 13.

The covering paper 74 binds the free edges of the panels to each other and covers the pairs of slots 52—52 and 56—56. As thus constructed, the easel may be set up as shown in FIGS. 1 and 2 by bending the headboard 12 relative to the support 10, the effect of which is to displace the leg 42 and the latch 44 from the rear side of the support at an angle corresponding to the angle of the headboard relative to the support and to displace the brace 46 downwardly from the support into engagement with the lower end of the latch 44.

The brace 46 which lies in a plane rearwardly of the latch 44 is automatically displaced away from the underside of the support as the leg 42 is moved into its supporting position by bending the headboard relative to the support to an extent such as to place a considerable amount of bending stress on the brace 46, the material of which is inherently resistant to flexing, so that, when its distal end reaches the distal end of the latch, the two become elastically interengaged with an audible snap.

Figure 4:
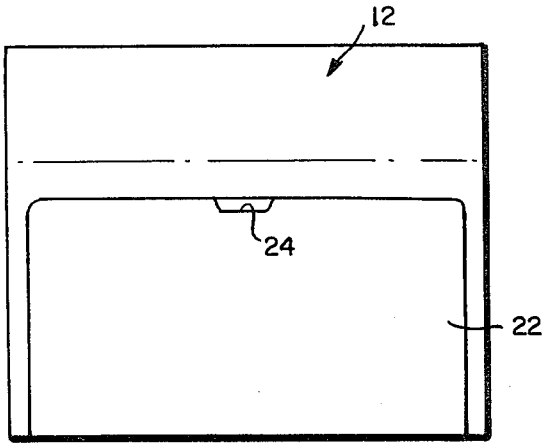
FIG. 4 is a plan view of the front side of the mount prior to setting up and with the calendar pad omitted.
Figure 5:
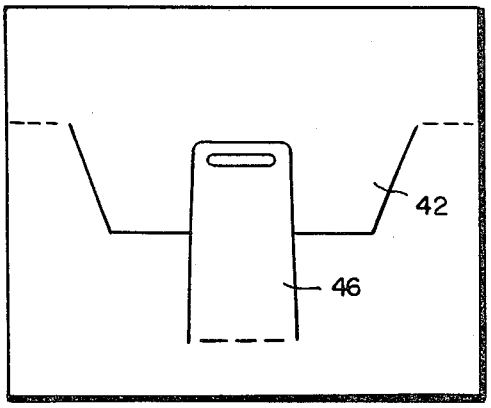
FIG. 5 is a plan view of the back side of the mount prior to setting up.

The easel may be readily restored to its flat condition as shown in FIG. 4 by disengaging the end of the brace 46 from the lower edge of the latch 44.

As shown in FIGS. 1 and 14, the panel 22 is provided for by a three-sided cut 78, FIG. 14, to release it from the front ply 26 along three sides so that it can be folded outwardly from the lower edge about the hinge 32 which connects the lower edge of the ply 26 to the ply 28. When so folded outwardly, the inner side of the panel 22 and the upwardly-facing side of the ply 28 provide, in conjunction, index surfaces for telephone numbers and addresses. To assist in folding the panel 22 outwardly, the upper edge, as shown in FIGS. 1, 14 and 15, is provided with a finger notch 24. If desired, the panel 22 may be omitted and the calendar pad stapled directly to the front ply 26 or the panel may be provided without a calendar pad.

The invention has been described with reference to making a single easel; however, in practice, the sheets 48 and 50 are made large enough so that twelve easels can be made simultaneously and separated one from another after the dyeing and cutting operations described into separate easel blanks which are then folded, as shown in FIGS. 10, 11 and 12 to provide individual easels.

After folding, the folded structure is wrapped with either one of two types of paper; discoloration paper which is called that because it changes color when heat is applied or a non-discoloration paper. Following wrapping, the structure is heat-embossed so that the discoloration of the discoloration paper, if used, takes place and the panel 22 is cut out as the final die-cutting operation. If a calendar pad is to be used, it is stitched onto the panel 26 and the customer's copy is stamped on the headboard.

It should be understood that the present disclosure is for the purpose of illustration only and includes all modifications or improvements which fall within the scope of the appended claims.

What is claimed is:

1. An easel comprising coextensive rectangular front and back panels of two-ply construction bound along at least two parallel edges, said panels being foldable transversely further from one end than the other to form a support and headboard along one edge thereof and leg and brace members cut out of the panels elastically interengageable to hold the support and headboard at an obtuse angle relative to each other, characterized in that said leg comprising both plies of the back panel and the back ply of the front panel such that the front ply of the front panel is imperforate and said brace comprises both plies of the back panel.

2. An easel according to claim 1 wherein there is a hinged panel coextensive with and disposed upon the support.

3. An easel comprising coextensive rectangular front and back panels of two-ply construction bound along at least two parallel edges, said panels being bent transversely at an obtuse angle such as to provide a low angle support and a headboard, a leg comprising a rigid, in-the-same-plane extension of the back panel of the headboard and means for holding the leg displaced from the support such that its free end in conjunction with the free end of the support supports the easel in a standing position, said means comprising a brace bent downwardly from the back panel of the support and a latch plate comprising an in-the-same-plane extension of the rear ply of the front panel of the headboard with which the free end of the brace is elastically engaged, said latch plate comprising a part substantially coextensive with the leg held by the brace in engagement with the forwardly-facing side of the leg.

4. An easel according to claim 3 wherein there is a hinged panel coextensive with and disposed upon the support.

5. An easel according to claim 2 wherein the hinged panel is hinged at its lower edge to the lower edge of the support for folding outwardly therefrom.

6. An easel according to claim 3 wherein the hinged panel is hinged at its lower edge to the lower edge of the support for folding outwardly therefrom.

7. An easel comprising an inclined support, a headboard at the upper edge of the support positioned at an obtuse angle thereto comprised of front and rear panels, a leg for, in conjunction with the lower edge of the support, supporting the easel in an upright position, said leg comprising a rigid, in-the-same-plane extension of the rear panel of the headboard and means for holding the leg and, hence, the headboard at said obtuse angle relative to the support comprising a rigid, in-the-same-plane extension of the rear ply of the front panel of the headboard abutting the front side of the leg and brace sprung downwardly from the underside of the support into engagement with said latter extension, said extension being substantially coextensive in area with the leg.

8. An easel according to claim 7 wherein there is a hinged panel coextensive with and disposed upon the support.

9. An easel according to claim 8 wherein the hinged panel is hinged at its lower edge to the lower edge of the support.

10. An easel comprising a headboard, a first leg comprising a rigid, in-the-same-plane extension of the rear side of the headboard, a second leg comprising a hinged extension of the front side of the headboard positioned at an obtuse angle relative to the headboard and means for holding and the legs spread apart comprising a rigid, in-the-same-plane latch extending from the headboard parallel to the first leg at an angle to the support which is the supplement of the obtuse angle and a brace elastically connected at one end to the rear side of the second leg with its distal end elastically interlocked with the latch.

11. An easel according to claim 10 wherein there is a hinged panel coextensive with and disposed upon the support.

12. An easel according to claim 11 wherein the hinged panel is hinged along its lower end to the lower edge of the support.

* * * * *